US008489391B2

(12) United States Patent
Kurniawati et al.

(10) Patent No.: US 8,489,391 B2
(45) Date of Patent: Jul. 16, 2013

(54) SCALABLE HYBRID AUTO CODER FOR TRANSIENT DETECTION IN ADVANCED AUDIO CODING WITH SPECTRAL BAND REPLICATION

(75) Inventors: Evelyn Kurniawati, Singapore (SG); Sapna George, Singapore (SG)

(73) Assignee: STMicroelectronics Asia Pacific Pte., Ltd., Singapore (SG)

( * ) Notice: Subject to any disclaimer, the term of this patent is extended or adjusted under 35 U.S.C. 154(b) by 287 days.

(21) Appl. No.: 12/851,454

(22) Filed: Aug. 5, 2010

(65) Prior Publication Data

US 2012/0035936 A1 Feb. 9, 2012

(51) Int. Cl.
*G10L 19/00* (2006.01)
*G10L 19/02* (2006.01)

(52) U.S. Cl.
USPC ..... 704/206; 704/500; 704/501

(58) Field of Classification Search
USPC ..... 704/200.1, 201, 205, 206, 500, 501
See application file for complete search history.

(56) References Cited

U.S. PATENT DOCUMENTS

| | | | | |
|---|---|---|---|---|
| 6,453,282 | B1 * | 9/2002 | Hilpert et al. | 704/200.1 |
| 6,597,961 | B1 * | 7/2003 | Cooke | 700/94 |
| 6,826,525 | B2 * | 11/2004 | Hilpert et al. | 704/200.1 |
| 7,460,993 | B2 * | 12/2008 | Chen et al. | 704/230 |
| 7,546,240 | B2 * | 6/2009 | Mehrotra et al. | 704/230 |
| 7,917,237 | B2 * | 3/2011 | Kawamura et al. | 700/94 |
| 8,351,614 | B2 * | 1/2013 | Wu et al. | 381/63 |
| 2004/0181403 | A1 * | 9/2004 | Hsu | 704/230 |
| 2007/0005349 | A1 * | 1/2007 | Absar et al. | 704/203 |
| 2007/0078541 | A1 * | 4/2007 | Rogers | 700/94 |
| 2007/0162277 | A1 * | 7/2007 | Kurniawati et al. | 704/200.1 |
| 2007/0242833 | A1 * | 10/2007 | Herre et al. | 381/61 |
| 2007/0255562 | A1 * | 11/2007 | Kurniawati et al. | 704/230 |
| 2007/0282603 | A1 * | 12/2007 | Bessette | 704/219 |
| 2008/0120116 | A1 * | 5/2008 | Schnell et al. | 704/500 |
| 2008/0215317 | A1 * | 9/2008 | Fejzo | 704/217 |
| 2011/0046965 | A1 * | 2/2011 | Taleb et al. | 704/501 |

OTHER PUBLICATIONS

International Standard ISO/IEC 14496-3, "Information Technology—Coding of Audio-Visual Objects—Part 3: Audio, Amendment 2: Audio Lossless Coding (ALS), new audio profiles and BSAC extensions", Mar. 15, 2006, 88 Pages.*

* cited by examiner

*Primary Examiner* — Martin Lerner
(74) *Attorney, Agent, or Firm* — Munck Wilson Mandals, LLP

(57) ABSTRACT

A system method of reusing information in a low power scalable hybrid audio encoder are disclosed. The includes determining a state of an advanced audio coding (AAC) transient flag, performing spectral band replication (SBR) transient detection on at least two possible locations upon a determination that the AAC transient flag is equal to a first value, performing SBR transient detection on a high frequency upon a determination that the AAC transient flag is equal to a second value, and determining whether a transient exists. The system includes a spectral band replication (SBR) coding module configured to determine a state of an advanced audio coding (AAC) transient flag and perform SBR transient detection on at least one location based upon an energy in a signal upon a determination that the AAC transient flag is equal to a first value.

20 Claims, 7 Drawing Sheets

-PRIOR ART-

200

300

SCALABLE HYBRID AUTO CODER FOR TRANSIENT DETECTION IN ADVANCED AUDIO CODING WITH SPECTRAL BAND REPLICATION

TECHNICAL FIELD

The disclosure relates generally to processing systems and in particular to audio encoders. In one embodiment, for example, the present disclosure is generally applicable in the field of hybrid (parametric and transform) audio encoding for transmission or storage purposes, particularly those involving low power devices.

BACKGROUND

Digital audio transmission generally requires a considerable amount of memory and bandwidth. To achieve an efficient transmission, signal compression needs to be employed. Efficient coding systems are those that could optimally eliminate irrelevant and redundant parts of an audio stream. The first is achieved by reducing psycho acoustical irrelevancy through psychoacoustics analysis. The second is through modeling of the signal using a set of functions or through a prediction tool.

There are basically two different coding approaches for compression purpose: transform coding and parametric coding. Transform coders generally use the signal's frequency domain representations and perform psychoacoustics analysis to allocate the quantization noise below the noticeable level of human auditory systems. Parametric coder on the other hand, decomposes signals into parameterized components. Only these parameters are subsequently coded. Transform coders generally operate at much higher bit rates and have a higher quality than parametric coder. Some examples of conventional transform coders include Movie Picture Experts Group (MPEG) layer 1 to layer 3, MPEG-Advanced Audio Coding (AAC), etc., all of which require an operating rate around 128 kbps for good stereo quality. Parametric coders typically have an operating bit rate below 32 kbps. An example of a parametric coder is a MPEG-HILN coder.

Conventional high quality encoding efforts typically combine the two approaches above which results in a hybrid coder. One example is enhanced AAC plus (eAAC+) which combines a transform coder (AAC) with parameterized high frequency components (also known as Spectral Band Replication (SBR)) and a parametric stereo (PS) coder. A set of spatial parameters is firstly extracted from a stereo stream. After which, a stereo to mono down-mix is performed, and the mono stream is passed to the core transform coder. In the case of enhanced AAC plus, further parameterization is done to represent the high frequency component of this mono stream, and only the lower half of the mono streams is processed by the core transform coder. Without the parametric stereo portion, the scheme is called AAC plus. MPEG Audio Layer III (MP3) pro uses a similar scheme with MP3 as the core transform coder.

Transform coders rely on the fact that audio signals are stationary most of the time. There is generally an inherent artifact related to the presence of a transient called pre-echo, which refers to the spreading of quantization noise over the window length. To remedy this, most if not all transform coders come with a transient detection mechanism to determine the need to use shorter window length. Parametric coders also need similar detection mechanism to determine how often the parameter needs to be updated.

Transform and parametric coder were developed independently. Even after their union as a hybrid coder, there is no information being passed among them besides the Pulse Code Modulation (PCM) input data. The earlier explanation suggests that there is a redundant transient detection mechanism in a hybrid coder. This fact has systematically been exploited in conventional systems where inside an eAAC+ hybrid coder, the transient detection results from a parametric stereo portion are forwarded to the SBR and core AAC coder.

FIG. 1 generally illustrates the general structure of a conventional eAAC+ encoder 100 comprising an enhanced SBR encoder 102, an AAC encoder 104, and a bitstream payload formatter 106. The scheme works well because basically each of the modules is operating on the same signal. The difference is that the PS works on the original stereo signal, SBR works on the down-mixed monaural signal, and AAC works on the band limited monaural signal. The synchronization between the three modules makes it advantageous to put the transient detection inside the PS module not only because the PS module is operated first, but also since the analysis at this module contains the most complete version of the input signal. Furthermore, this detection was made as part of the parameter extraction, hence giving very little computational burden.

Encoders such as eAAC+ and MP3pro encoders combine the parameterization of the stereo component and the high frequency portion of the signal with an advanced transform coder operating only for one channel at half bandwidth. Despite the good compression ratio achieved, these coders typically have a very high complexity which is not suitable for application running on limited computational power.

SUMMARY

Systems and methods for combining a high quality transform coder with a very low bit rate parametric coder in a hybrid coder are disclosed. In one embodiment, the disclosure provides new methods for reducing the complexity of a hybrid coder by reusing the information across the different modules in the encoder. For example, in one embodiment, the disclosed coder feeds forward the transient information from the core encoder to the parametric encoder portion of the next frame.

Accordingly, embodiments of the disclosure generally exhibit accuracy and reduction of complexity. In addition, the present disclosure includes a scalability feature and the complexity reduction generally ranged from 8 to 15 percent. Embodiments of the disclosure are applicable, for example, to generic hybrid coders where low computational complexity is required.

Other technical features may be readily apparent to one skilled in the art from the following figures, descriptions and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

One embodiment of the present disclosure seeks to give an alternative low power implementation of a hybrid encoder, specifically those with a transform coder and parameterization of high frequency spectrum (SBR). The complexity of SBR transient detection in AAC+ encoder takes up to 15% of the whole encoding effort whereas the core coder (AAC) transient detection cost less than 3%. Firstly, this is because the SBR module is processing the full bandwidth signal whereas the core AAC coder only does half of it. Secondly, SBR has to determine the transient position from 16 possible positions whereas AAC needs to determine the transient position from 8 positions.

In addition, one embodiment of the present disclosure will provide a method to utilize the transient detection in AAC across the two modules such that the transient detection need not be computed twice. In one embodiment, the present disclosure relates generally to the information reuse in AAC+, without the presence of parametric stereo tool.

Figure 1:
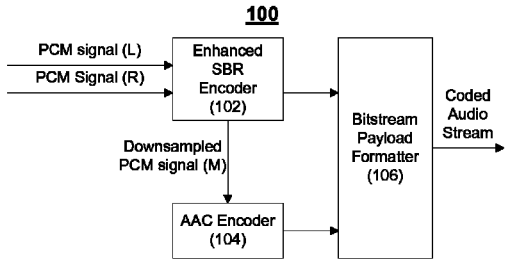
FIG. 1 is a block diagram illustrating an eAAC+ encoder according to one embodiment of the present disclosure.
Figure 2:
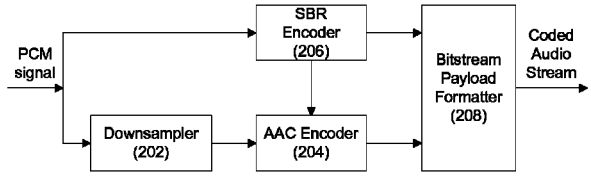
FIG. 2 is a block diagram illustrating an AAC+ encoder according to one embodiment of the present disclosure.

FIG. 2 shows a block diagram of an encoder 200. The embodiment of the encoder shown in FIG. 2 is for illustration only. Other embodiments of the encoder may be apparent without departing from the scope of this disclosure. FIG. 2 illustrates a PCM signal that is split and then fed into a downsampler 202 and an SBR encoder 206. The SBR encoder 206 outputs a signal into an AAC encoder 204 and a bitstream payload formatter 208. The downsampler 202 also outputs data into the AAC encoder 204.

The difference with eAAC+ is that in this case, the AAC is responsible for down-sampling the input PCM signal, and there is no hybrid filter delay. In fact, the hybrid filter delay makes it possible for parametric stereo transient detection results to be used in the same frame of SBR and AAC. In one embodiment, the present disclosure will instead use the AAC detection result for the next frame of SBR module.

Observing that both the parametric and transform coders are essentially processing the same signal, it is possible to facilitate information exchange between the two modules to avoid redundant computation. Since SBR is processing the full bandwidth signal, it has more accurate transient information. However, there are two reasons why the transient results from the core encoder are used instead.

First, the core coder detection has a much lower complexity.

Second, the core coder receives the input data ahead of the parametric coder due to the look ahead of block switching. As explained earlier, a transform coder has the capability to change to a shorter window length. This window length is preceded and followed by a transition window.

Figure 3:
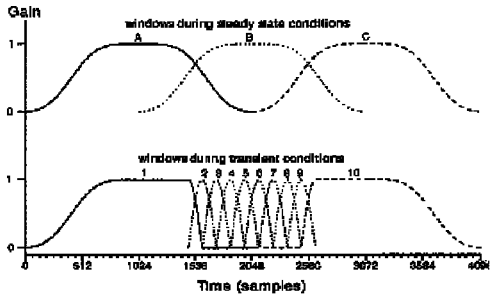
FIG. 3 is plot illustrating a block switching scenario in an AAC encoder according to one embodiment of the present disclosure.

FIG. 3 illustrates the transition in a graph 300 that occurs during block switching. The transition shown in FIG. 3 is for illustration only. Other embodiments for transition may be apparent without departing from the scope of this disclosure.

Due to this reason, the transient detection has to be performed one frame ahead of the processed frame. Notice that this problem was not present when a parametric stereo tool is used because there is an additional delay of one frame for the parametric coder portion.

The time index relationship between the modules is generally known. When using the result from the core coder however, a decision still needs to be made due to the different resolution of the transient position. This can be resolved using the original SBR transient detection positioning or using a simpler energy based positioning. The fact that the core coder is missing the high frequency component of the signal needs to be taken into consideration as well. These are the differences that make out the various working modes of the present disclosure, giving scalable accuracy and complexity.

According to one embodiment, there may be five different levels which give scalable quality and complexity reduction (0 being the original implementation with the highest quality and no computational reduction). Below is a brief explanation of each profile.

Level 0 generally includes the original implementation (SBR transient detection across full bandwidth).

Level 1 generally includes SBR transient detection for high frequency and resolves transient position information from AAC.

Level 2 generally includes SBR transient detection for high frequency, and simple energy based comparison to resolve transient position information from AAC.

Level 3 generally includes SBR transient detection only to resolve transient position information from AAC (high frequency transient is ignored).

Level 4 generally includes no SBR transient detection performed, and simple energy based comparison is used to resolve transient position information from AAC (high frequency transient is ignored).

Figure 4:
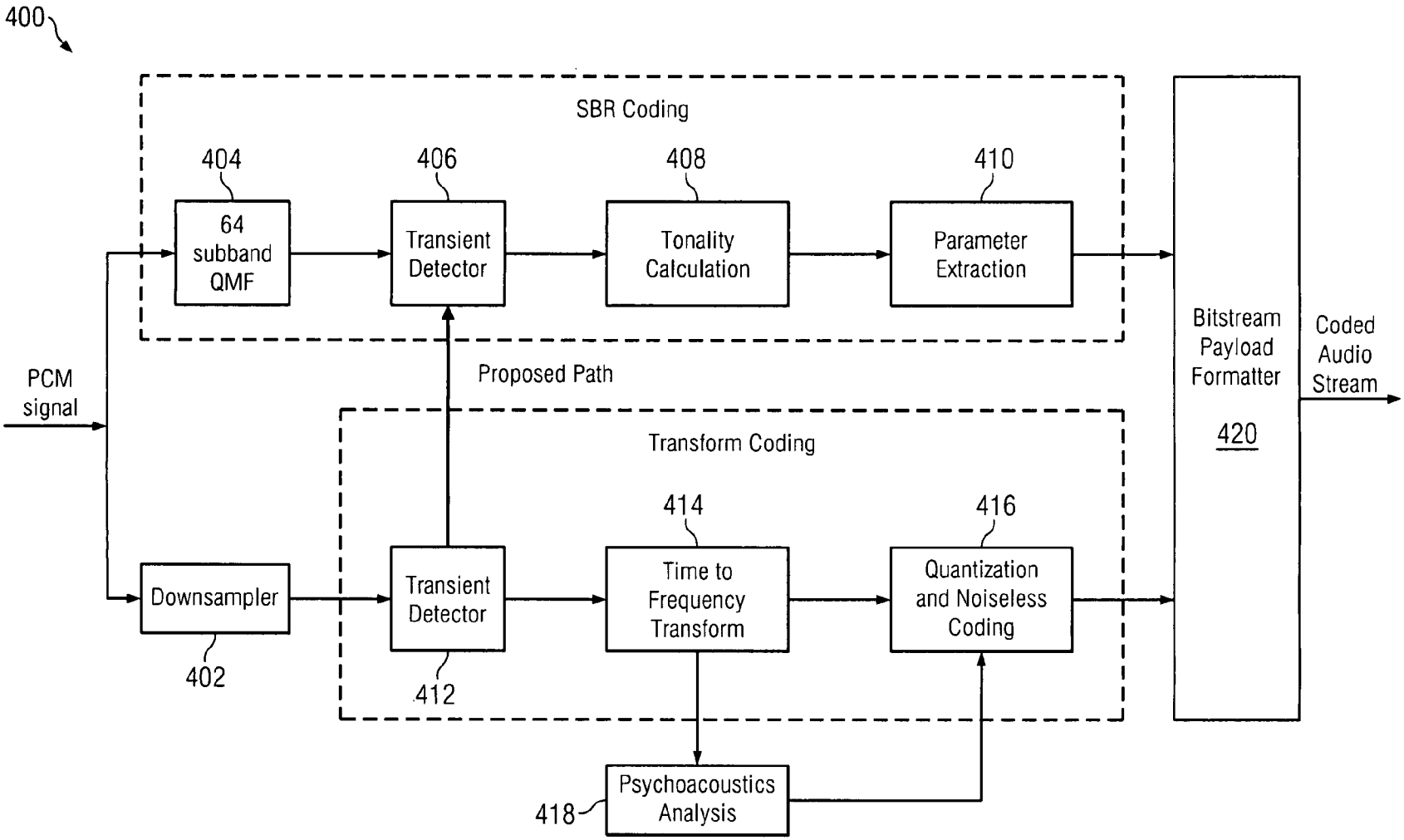
FIG. 4 is a block diagram illustrating an AAC+ encoder according to one embodiment of the present disclosure.

FIG. 4 illustrates a diagram 400 illustrating a hybrid coder according to one embodiment of the present disclosure. The embodiment of the hybrid coder shown in FIG. 4 is for illustration only. Other embodiments of the hybrid encoder may be apparent without departing from the scope of this disclosure. In the example shown in FIG. 4, a PCM signal is split and fed into a downsampler 402 and a 64 sub-band QMF 404. The output from the 64 sub-band QMF 404 is fed into a transient detector 406. The output from the transient detector 406 is fed into a tonality calculation 408, and the output from the tonality calculation unit 408 is fed into a parameter extraction unit 410. The output from the parameter extraction unit 410 is fed into a bit stream payload formatter 420.

The output from the downsampler 402 is fed into a transient detector unit 412. The output from the transient detector 412 is fed into the transient detector 406 and a time to frequency transform unit 414. The output from the time to frequency transform 414 is fed into a psychoacoustics analysis 418 and a quantization and noiseless coding unit 416. The output from the psychoacoustics analysis unit 418 is also fed into the quantization and noiseless coding unit 416. The output from the quantization and noiseless coding unit 416 is fed into the bit stream payload formatter 420.

The hybrid coder generally includes the parameterization of a high frequency component (SBR) and the core transform coder. The proposed path feed forwards the transient detection results from the core transform coder to the SBR coder.

It has been highlighted that SBR operates on the full bandwidth of the signal. Since the core coder only processes half of the bandwidth, the SBR coder would still need to perform the detection on the upper half of its frequency range for the most accurate results. The implementation is straightforward since the original detection of this module is done on frequency band basis, namely on the 64 QMF subband. This is one advantage gained from the SBR structure.

As shown in FIG. 4, the transient detector of a SBR codec is generally placed after the filter in one embodiment. The computational savings for this case will be half of the normal SBR transient detection processing, which is around 7% of the encoding effort. This method corresponds to level 1 and level 2 profiles according to one embodiment of the present disclosure.

When a more demanding computational saving is desired, however, it is possible to ignore the presence of transients in the high frequency region. This was also supported by the psychoacoustical fact that the human ear is generally more sensitive in the lower frequency region. Maximum complexity reduction of up to 15% can be achieved. This method corresponds to level 3 and 4 profiles according to one embodiment of the present disclosure.

The only issue regarding the reuse of transient information is the mismatch in resolution of the core coder and the SBR coder with the later having twice the resolution. In other words, for every position of a transient forwarded from the core coder, there are two possible positions in the SBR coder. In the case of an AAC+ encoder, there are 8 possible transient positions for AAC and 16 for SBR. For highest accuracy, the original SBR transient detection is employed only at the two possible positions as indicated by the information from AAC. This method is used in level 1 and level 3 profiles.

For the maximum complexity reduction, it is possible to opt for a simpler selection method between the two possible positions. Since transients are primarily a sudden rise of energy in the time domain, the chosen position is one that has a higher energy than the other. The mapping strategy in this case becomes very straight forward and does not introduce any additional complexity. The energy comparison information can be extracted during the AAC detection itself, and the SBR module transient detection can simply be bypassed. The results, however, are not as accurate as the previous method compared to the original SBR detection algorithm. This method is employed in level 2 and level 4 profiles.

3rd Generation Partnership Project (3GPP) has defined a set of conformance testing to verify that the implementation of eAAC+ matches the relevant specifications of 3GPP. Conformance testing focuses on the core algorithm. The passing criteria for transient detectors is that the RMS value of the difference between the transient position vector of the encoder under test and the reference encoder is not greater than 0.2. The reference encoder here is the fixed point implementation of eAAC+ encoder by 3GPP. In a particular embodiment, two test streams are used to test transient detection algorithm: "hihat.wav" and "ct_castagnettes.wav". The streams and the conformance specifications are generally downloadable from 3GPP website.

The proposed feed forward algorithm is evaluated using the above conformance criteria. This is where accurate mapping of the transient position becomes crucial. AAC transient results narrow down all of the possibility of SBR positions down to two positions. To maintain objective conformance explained earlier as defined by 3GPP, SBR transient detection still needs to be performed on these two possible positions. At level 3 profile, the resulting RMS value is 0.174078 for hihat and 0.088388 for castanet; both are below the 0.2 threshold.

Figure 5:
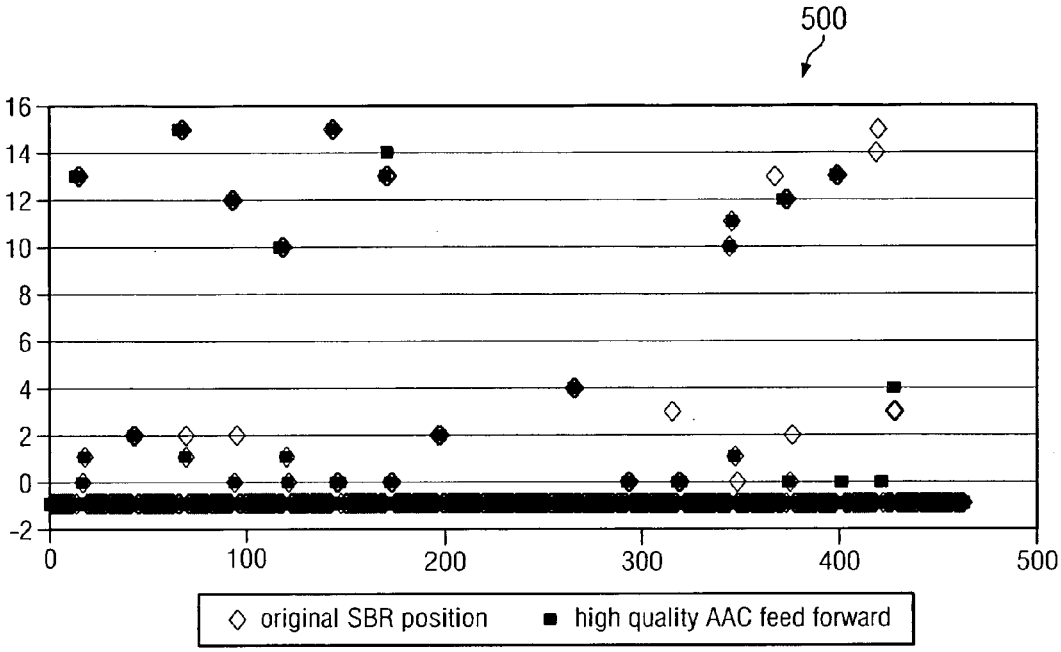
FIG. 5 is a plot comparing the SBR transient detection results between the original 3GPP implementation and the high quality version of this embodiment for hihat signal, where a root-mean-square (RMS) value of 0.174078 is achieved, according to one embodiment of the present disclosure.

FIG. 5 is a plot 500 that generally illustrates the transient position results between the original and the feed forward method for the hihat signal according to one embodiment of the present disclosure. The plot 500 shown in FIG. 5 is for illustration only. Other embodiments of the plot may be apparent without departing from the scope of this disclosure.

Figure 6:
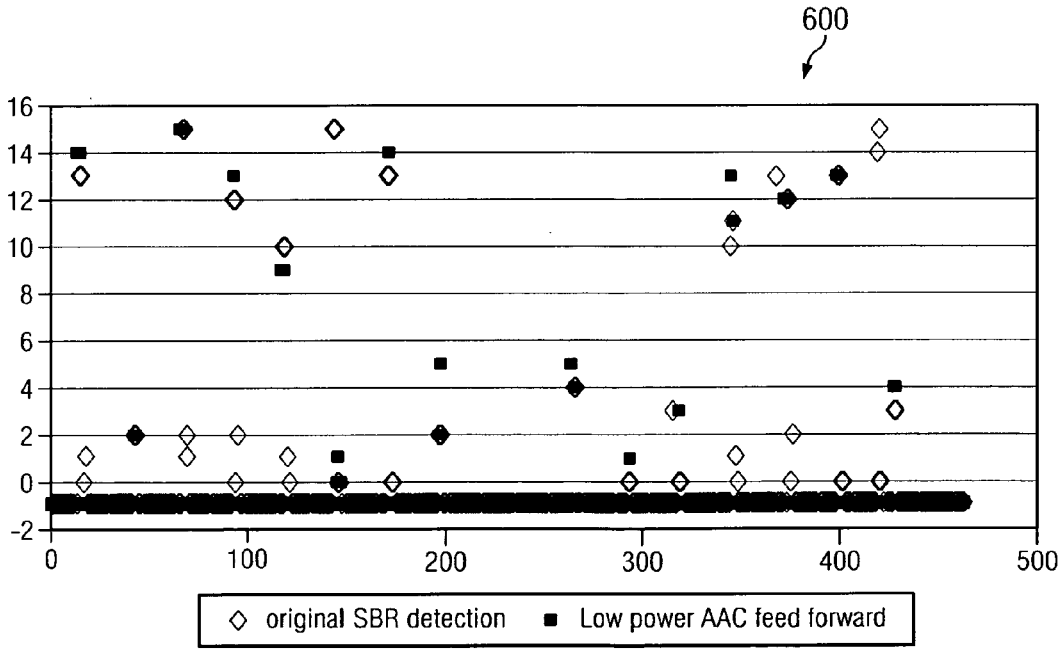
FIG. 6 is a plot comparing the SBR transient detection results between the original 3GPP implementation and the low power version for the hihat signal, where a RMS value of 0.301511 is achieved, according to one embodiment of the present disclosure.

The horizontal axis shows the frame number and the vertical axis shows the SBR transient position. Minus one is used to indicate that transient is not present in that frame. With the maximum complexity reduction profile (level 4), the RMS value is 0.301511 for hihat, failing the conformance criteria, and 0.1875 for castanet. FIG. 6 shows a plot 600 that illustrates the transient position results comparison using this method for hihat signal. Despite failing the conformance criteria, there is very little impact on the resulting perceptual quality for this method because as seen in FIG. 6, most of the errors are from mis-positioning the transients instead of mis-detecting them.

FIGS. 7 and 8 generally illustrate flowcharts showing a high quality version (level 1 and 2) and a low power version (level 3 and 4) of a transient feed forward scheme according to one embodiment of the present disclosure. The flowcharts shown in FIGS. 7 and 8 are for illustration only. Other embodiments of the flowcharts may be apparent without departing from the scope of this disclosure.

The difference between FIGS. 7 and 8 is the presence of high frequency transient detection, whereas between 7*a* and 7*b* or 8*a* and 8*b* is the way the transient position is resolved (one is using the SBR detection, and the other is using a simpler energy based comparison).

Figure 7A:
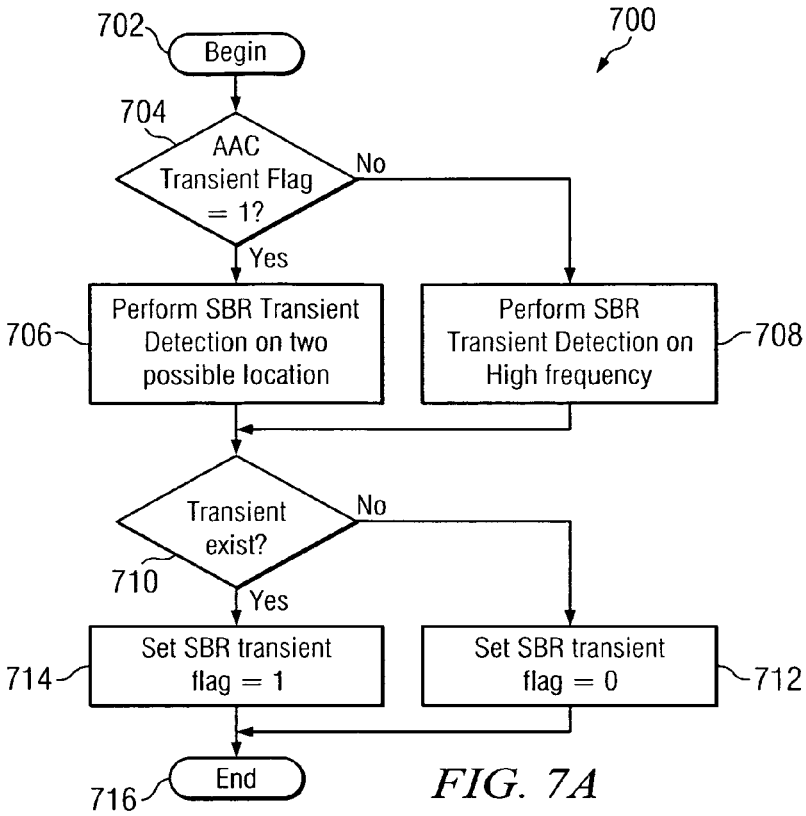
FIG. 7 is a somewhat simplified flow diagram of a high quality version of a transient feed forward scheme (7*a* and 7*b* correspond to level 1 and level 2 profiles) according to one embodiment of the present disclosure.

In FIG. 7A, a process 700 begins at block 702 and proceeds to a determination of whether the AAC transient flag is equal to one in block 704. If the AAC transient flag is not equal to 1, the SBR transient detection is performed on high frequencies in block 708. If the AAC transient flag is equal to one, an SBR transient detection is performed on two possible locations in block 706. After blocks 706 and 708, there is a determination if a transient exists in block 710. If there is no transient, then the SBR transient flag is set to zero in block 712. If there is a transient, then the SBR transient flag is set to one in block 714. The process ends in block 716.

Figure 7B:
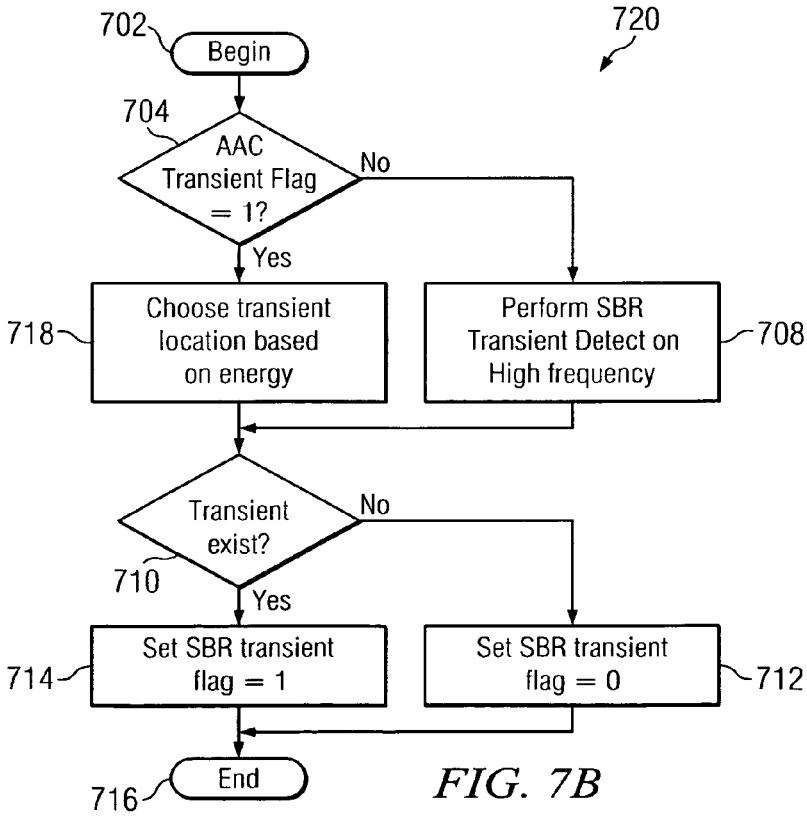

In FIG. 7B, a process 720 begins at block 702 and proceeds to a determination of whether the AAC transient flag is equal to one in block 704. If the AAC transient flag is not equal to 1, SBR transient detection is performed on high frequencies in block 708. If the AAC transient flag is equal to one, the transient position is resolved using an energy-based comparison in block 718. After blocks 718 and 708, there is a determination if a transient exists in block 710. If there is no transient, then the SBR transient flag is set to zero in block 712. If there is a transient, then the SBR transient flag is set to one in block 714. The process ends in block 716.

Figure 8A:
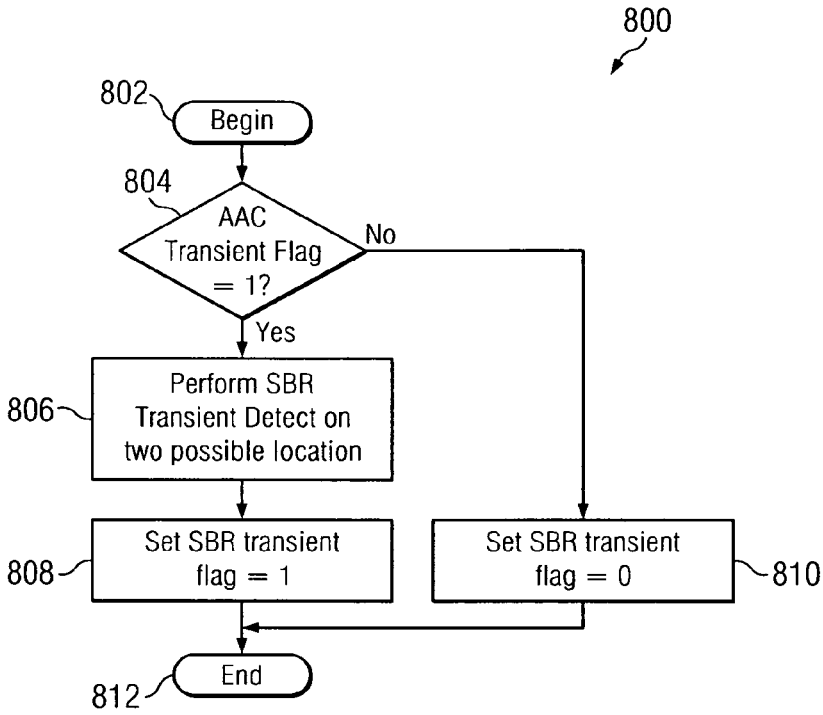
FIG. 8 is a somewhat simplified flow diagram of a low power version of the transient feed forward scheme (8*a* and 8*b* correspond to level 3 and level 4 profiles) according to one embodiment of the present disclosure.

FIG. 8A illustrates a process 800 which begins at block 802 and proceeds to a determination of whether the AAC transient flag is equal to one in block 804. If the AAC transient flag is equal to one, an SBR transient detection is performed on two possible locations in block 806 and an SBR transient flag is set to one in block 808. If the AAC transient flag is not equal to 1, then the SBR transient flag is set to zero in block 810.

Figure 8B:
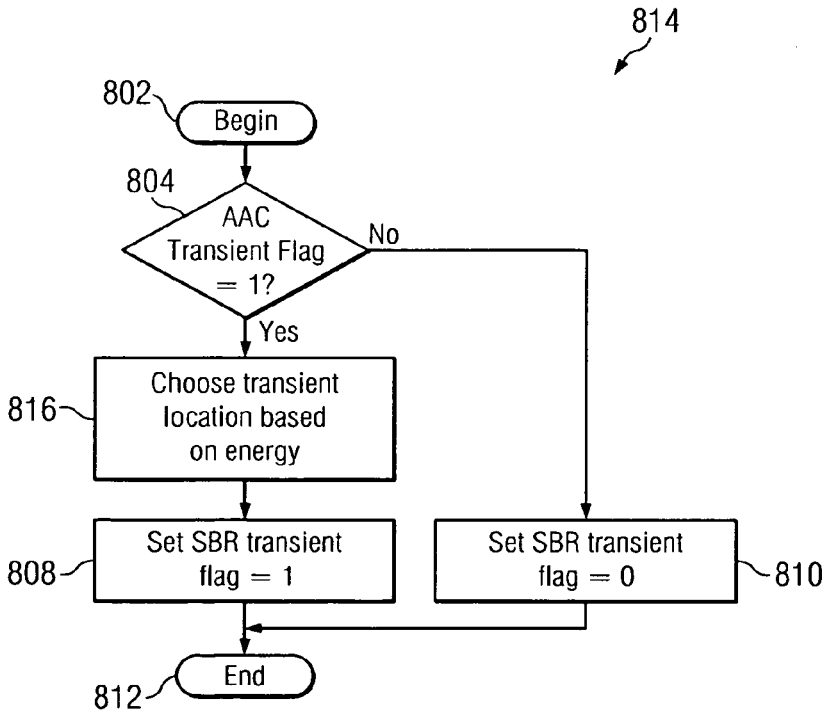

FIG. 8B illustrates a process 814 which begins with block 802 and proceeds to a determination of whether the AAC transient flag is equal to one in block 804. If the AAC transient flag is equal to one, a transient location is chosen based upon energy in block 816 and a SBR transient flag is set to one in block 808. If the AAC transient flag is not equal to 1, then the SBR transient flag is set to zero in block 810.

Figure 9:
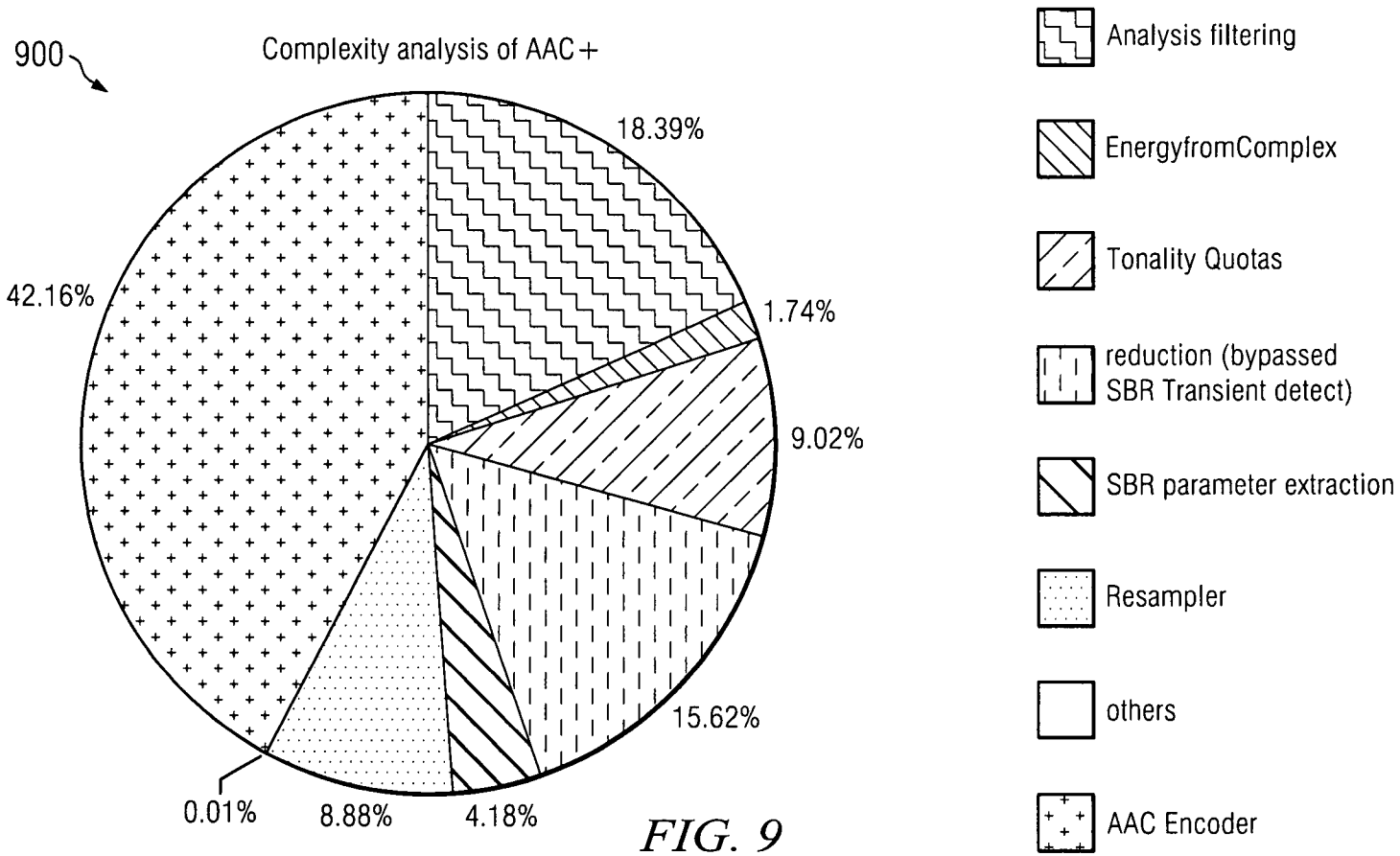
FIG. 9 is a somewhat simplified pie chart illustrating a complexity reduction of an AAC+ encoder with the low power transient feed forward scheme according to one embodiment of the present disclosure.

FIG. 9 shows a chart 900 generally illustrating a complexity analysis of a low power encoder according to an embodiment of the present disclosure. The chart 900 shown in FIG. 9 is for illustration only. Other embodiments of the charts may be apparent without departing from the scope of this disclosure.

The complexity analysis of FIG. 9 generally shows a reduction of up to 15%, gained from bypassing the transient detection module.

Accordingly, the present disclosure may be applied to any suitable hybrid encoder which uses parameterization of its high frequency components coupled with a generic transform coder. In this section, it will be demonstrated how embodiments of the present disclosure apply to AAC+ encoders. The proposed structure of the AAC+ encoder is shown in FIG. 4, having AAC as its transform coder.

Figure 10:
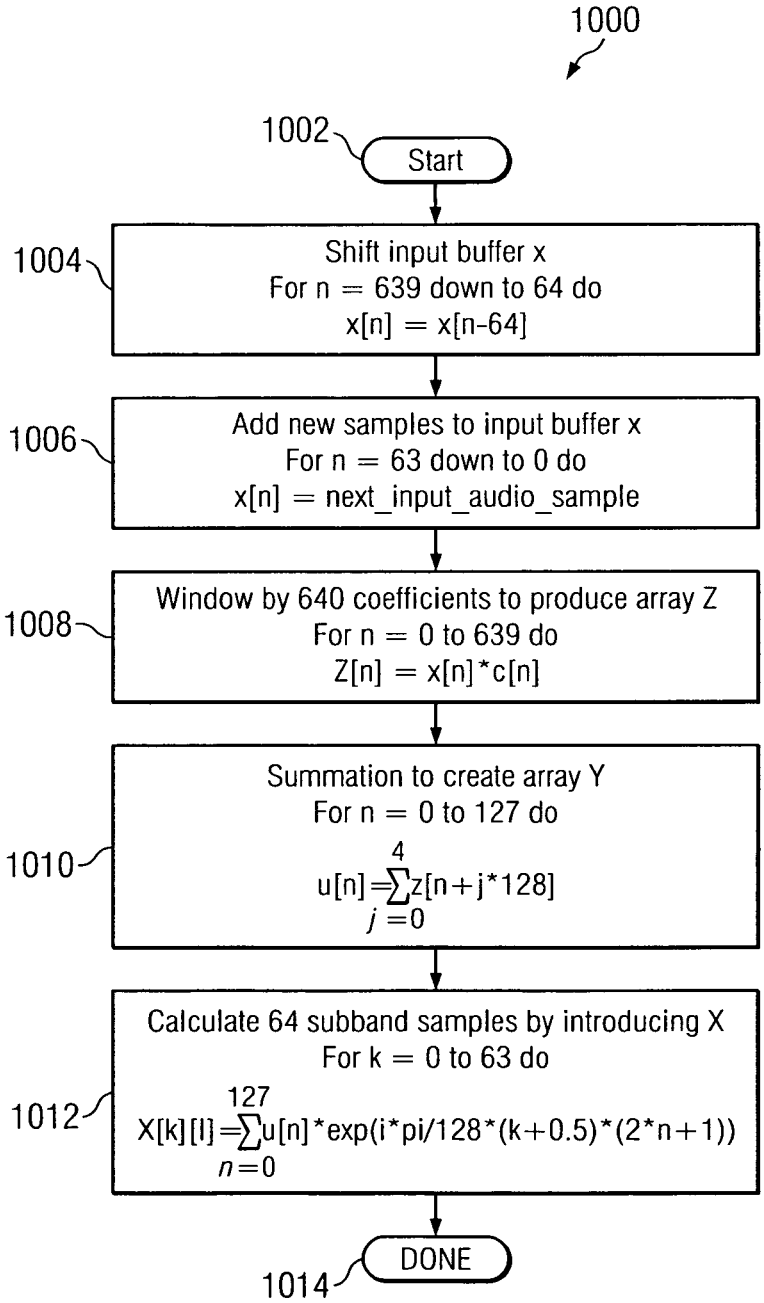
FIG. 10 is a somewhat simplified flow diagram illustrating an encoder analysis of a Quadrature Mirror Filter (QMF) bank according to one embodiment of the present disclosure.

A method of QMF analysis using a filterbank to process the stream is generally shown in the flow chart found in FIG. 10. The flowchart shown in FIG. 10 is for illustration only. Other embodiments of the QMF analysis may be apparent without departing from the scope of this disclosure.

The transient detector is the module where one embodiment of the present disclosure takes place. Originally, the transient detection is performed on sub-band samples and a transient flag and position are output. In one embodiment, both the transient flag and the position are taken from the results of the core coder, and appropriate operations are performed depending on the level of accuracy and complexity reduction desired.

In a Level 4 profile, for maximum complexity reduction, the transient position flag from AAC is used to narrow all of the possible positions of a SBR transient down to two positions, and a simple energy comparison is used to determine the onset of the SBR transient. No extra processing is incurred in this case as the energy information is a side product of the AAC transient detects itself.

In a Level 3 profile, for an increase in accuracy, the SBR transient detection can still be performed, but only on the two possible positions as derived from AAC transient position. With this method, 3GPP conformance criteria for transient detection can be passed.

In a Level 2 profile, for the highest accuracy, the transient detection also needs to be performed on the upper half of the frequency component as this part is ignored by the core transform coder. However, as explained earlier, even without the high frequency detection, the disclosed schemes of the present disclosure are able to pass the objective conformance criteria from 3GPP, indicating that the mismatch with the original algorithm is negligible. This level uses simple energy comparison to resolve the transient position obtained from AAC.

In a level 1 profile, the accuracy increases further as compared to level 2 by using the SBR transient detection to resolve the transient position (in a similar fashion as level 3 profile).

In a Level 0 profile, the level corresponds to the original implementation where transient detection is performed independently both for core the coder (AAC) portion and the parametric (SBR) portion.

The tonality is derived from the prediction gain of a second order linear prediction performed in every QMF subband. This information is crucial for some of the extraction of the SBR parameter. The patching of high frequency component is performed as much as possible to maintain the tonality characteristics of the input signal.

Parameter extraction is where envelope, noise floor, inverse filtering, and additional sines estimation is performed.

Since the upper part of the frequency component has been parameterized by the SBR encoder, the core coder need not process that portion anymore. The downsampler's duty is to retain only the lower half of the frequency component of the input signal to be forwarded to the core transform coder for further processing.

In AAC+, the core coder needs only to process the stream at half its original input bandwidth. This reduces the task of this core coder significantly. The four main processing performed in AAC encoder are as follows:

The decision to use either a long or a short window is made at a transient detector. Since the coder needs to use a start block preceding a short block, the detection is performed one frame ahead of the processed frame. This was the reason why in this embodiment, the feed forwarded result from AAC is relevant for the next frame SBR module. The look ahead scenario is generally known.

The detection is performed in time domain by comparing the energy of a subblock with a sliding average of the previous energies. Transient is detected if the ratio exceeds the predetermined constant. In this embodiment, during the subblock energy calculation, information is also extracted on whether the first half or second half of the subblock has a larger energy. This information is used to decide the onset of transient in SBR module, since they have a higher subblock resolution.

In a particular embodiment, AAC uses Modified Discrete Cosine Transform (MDCT) as its time to frequency transform engine as shown in Equation 1 below:

$$X_{i,k} = 2\sum_{n=0}^{N-1} z_{i,n}\cos\left(\frac{2\pi}{N}(n+n_o)\left(k+\frac{1}{2}\right)\right), \text{ for } 0 \le k \le N/2. \quad \text{[Eqn. 1]}$$

In Equation 1, z is the windowed input sequence, n is sample index, k is spectral coefficient index, i is the block index, N is window length (2048 for long and 256 for short) and $N_o$ is computed as (N/2+1)/2.

In a psychoacoustics analysis module, the masking threshold is calculated based on the signal energy in the bark domain. The masking threshold represents the amount of noise that the human ear can tolerate. This calculation is crucial because the allocation of quantization noise will be based on this threshold.

AAC uses a non-uniform quantizer as shown in Equation 2 below.

$$\text{x_quantized}(i) = \text{int}\left[\frac{x^{3/4}}{2^{\frac{3}{16}(gl-scf(i))}} + 0.4054\right]. \quad \text{[Eqn. 2]}$$

In Equation 2, i is the scale factor band index, x is the spectral values within that band to be quantized, gl is the global scale factor (the rate controlling parameter), and scf(i)

is the scale factor value (the distortion controlling parameter). With careful selection of the global and scale factor parameters, compression can be achieved by allocating the right amount of quantization noise below the masking threshold. Noiseless coding is then performed with eleven possible Huffman Codebook values.

The SBR parameter and the core AAC streams are then multiplexed into a valid AAC+ stream for transmission, storage, or other purposes at a bitstream payload multiplexer.

FIG. 10 illustrates a flowchart 1000 that begins with block 1002. In block 1004, there is a shift of the input buffer. In block 1006, a plurality of new samples is added to the input buffer. In block 1008, there is an array produced using a plurality of coefficients. In block 1010, there is a summation to create an array. In block 1012, there is a calculation of a sub band by the introduction of an "X". This method concludes in block 1014.

Accordingly, one embodiment of the present disclosure provides a system and method to reduce the complexity of a hybrid coder by reusing the transient detection information from the core transform coder to the parametric coder of the next frame. Higher accuracy can be obtained by performing normal detection on the upper half of the frequency range in SBR and/or by performing normal detection on the two candidate positions as narrowed down by the AAC result. For maximum complexity reduction of 15%, the presence of upper frequency transient can be ignored, and the transient position within SBR can be resolved by using simple energy comparison derived from AAC.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method of reusing information in a low power scalable hybrid audio encoder, the method comprising:

determining, by a processor, a state of an advanced audio coding (AAC) transient flag;

performing spectral band replication (SBR) transient detection on at least two possible locations upon a determination that the AAC transient flag is equal to a first value;

performing SBR transient detection on a high frequency upon a determination that the AAC transient flag is equal to a second value; and determining, by the processor, whether a transient exists.

2. The method of claim 1, wherein upon a determination that a transient exists, a SBR flag is set to a third value.

3. The method of claim 1, wherein upon a determination that a transient does not exist, a SBR flag is set to a fourth value.

4. The method of claim 1, wherein information from at least one transient coding is reused by either a SBR coding module or a transform coding module.

5. The method of claim 4, wherein the information from the at least one transform coding is reused in the SBR coding module.

6. The method of claim 1, wherein a complexity of the hybrid coder is reduced by reusing transient detection information from a core transform coder in a parametric coder of a next frame.

7. The method of claim 6, further comprising at least one of performing normal detection on an upper half of a frequency range in SBR and performing normal detection on two candidate positions as narrowed down by the AAC result.

8. The method of claim 7, wherein SBR transient detection is performed in time domain by comparing an energy of a subblock with a sliding average of previous energies.

9. The method of claim 8, wherein a transient is determined to exist when SBR transient detection produces a value that exceeds a predetermined constant.

10. A method of reusing information in a low power scalable hybrid audio encoder, the method comprising:

determining, by a processor, a state of an advanced audio coding (AAC) transient flag;

performing spectral band replication (SBR) transient detection on at least one location based upon an energy in a signal upon a determination that the AAC transient flag is equal to a first value;

performing SBR transient detection on a high frequency upon a determination that the AAC flag is equal to a second value; and determining, by the processor, whether a transient exists.

11. The method of claim 10, wherein upon a determination that a transient exists, a SBR flag is set to a third value.

12. The method of claim 10, wherein upon a determination that a transient does not exist, a SBR flag is set to a fourth value.

13. The method of claim 10, wherein information from at least one transient coding is reused by either a SBR coding module or a transform coding module.

14. The method of claim 13, wherein the information from the at least one transform coding is reused in the SBR coding module.

15. The method of claim 14, wherein a complexity of the hybrid coder is reduced by reusing transient detection information from a core transform coder in a parametric coder of a next frame.

16. The method of claim 15, further comprising at least one of performing normal detection on an upper half of a frequency range in SBR and performing normal detection on two candidate positions as narrowed down by the AAC flag.

17. The method of claim 15, wherein SBR transient detection is performed in time domain by comparing an energy of a subblock with a sliding average of previous energies.

18. The method of claim 17, wherein a transient is determined to exists when SBR transient detection produces a value that exceeds a predetermined constant.

19. A system of reusing information in a low power scalable hybrid audio encoder, the system comprising:

a spectral band replication (SBR) coding module, using a processing system of a low power audio communication device, configured to determine a state of an advanced audio coding (AAC) transient flag and perform SBR transient detection on at least one location based upon an energy in a signal upon a determination that the AAC transient flag is equal to a first value;

a transform coding module using the processing system and configured to perform SBR transient detection on a high frequency upon a determination that the AAC transient flag is equal to a second value; and a bitstream payload formatter configured to output data from the hybrid audio encoder.

20. The system of claim 19, wherein a transient detector from the transform coding module is used in the SBR coding module.

* * * * *